United States Patent [19]

Jurascheck et al.

[11] 4,300,476

[45] Nov. 17, 1981

[54] APPARATUS FOR THE STIFFENING OF TEXTILE SHEETS BY COATING WITH PLASTIC

[75] Inventors: Richard Jurascheck; Karl-Heinz Nolte, both of Vlotho, Fed. Rep. of Germany

[73] Assignee: Herbert Kannegiesser GmbH & Co., Vlotho, Fed. Rep. of Germany

[21] Appl. No.: 153,232

[22] Filed: May 27, 1980

[30] Foreign Application Priority Data

May 25, 1979 [DE] Fed. Rep. of Germany ..... 2921102

[51] Int. Cl.[3] ..... B05C 1/02

[52] U.S. Cl. ..... 118/694; 118/203; 118/249; 118/259; 118/603

[58] Field of Search ..... 118/203, 212, 259, 694, 118/603, 249

[56] References Cited

U.S. PATENT DOCUMENTS

| | | | |
|---|---|---|---|
| 2,759,449 | 8/1956 | Lindquist | 118/312 X |
| 3,155,541 | 11/1964 | Jackson | 118/203 |
| 3,339,485 | 9/1967 | Rytterholm | 118/694 X |
| 3,818,860 | 6/1974 | Rebentisch | 118/203 X |
| 3,927,409 | 12/1975 | Kase et al. | 118/603 |
| 4,173,199 | 11/1979 | Fassina | 118/245 X |

*Primary Examiner*—John P. McIntosh

*Attorney, Agent, or Firm*—Sughrue, Mion, Zinn, Macpeak and Seas

[57] ABSTRACT

In an apparatus for coating fabric sheets with plastic stiffening strips and including a conveyor 15 for feeding sheets through the nip between a drive roller 16 and a printing cylinder 14, a flexible doctor blade 20 wipes unused plastic and fluff contaminant from the cylinder. The wiped material falls into a collecting trough 21 and is screw conveyed to a supply reservoir 24, from which it is filtered and pumped back to the printing cylinder feed reservoir 18 under the control of a level sensor 19 mounted therein.

2 Claims, 2 Drawing Figures

APPARATUS FOR THE STIFFENING OF TEXTILE SHEETS BY COATING WITH PLASTIC

BACKGROUND OF THE INVENTION

This invention relates to an apparatus for stiffening textile sheets of various shapes for the manufacture of outerwear garments by coating them with plastic, said apparatus consisting of a conveyor mechanism for the textile sheets and a gravure printing cylinder arranged the conveyor mechanism and having a plastic feed mechanism for supplying fresh coating plastic thereto.

The prior art (see, for example, German Offenlegungsschrift No. 2,552,878) relating to fabric stiffening using plastic coatings fails to satisfactorily deal with the problem of the inevitable contamination of the printing cylinder, and particularly the depressions therein, resulting from fluff deposits, etc., or with the utilization of the pasty plastic not used up in a coating operation which remains in the depressions of the printing cylinder. Circumferential grooves on printing cylinders often tend to become clogged by these impurities, and plastic remaining in the grooves hardens and likewise clogs them. This clogging leads to variations in the coating pattern. For example, clogged grooves lead to a non-uniform linear coating and/or a reduction of the coating thickness, and this is undesirable.

SUMMARY OF THE INVENTION

The object of this invention is to provide an apparatus with which the problem of variation of the coating pattern due to impurities and excess plastic is solved with simple means in an altogether economical and practical way, allowance being made for the fact that the printing cylinders used at the present time on the known apparatus have a diameter of only about 260 mm and a length of up to 1400 mm.

In the apparatus of the invention the elevations and depressions of the outer surface are cleaned after the coating operation by a doctor blade, and the material thus removed is led to a reservoir also containing additional plastic, which is filtered and returned to the printing cylinder as needed.

The invention ensures that before coating, a plastic free from impurities is filled into the depressions of the printing cylinder, that the depressions are free of impurities and excess plastic and, furthermore, that there are no impurities on the portion of the printing cylinder surface not provided with depressions, so that the textile sheets are always coated uniformly and evenly. The apparatus is economical and practical since the impurities and excess plastic are completely removed from the printing cylinder using simple means and the excess plastic is fed back, together with new plastic, to the printing cylinder, whereby no unused plastic is lost. Due to the filtering, any impurities present in the unused plastic are eliminated. From a practical point of view it is especially advantageous that the invention can be utilized without altering the printing cylinder or changing its diameter, and can be added to existing coating apparatuses.

DETAILED DESCRIPTION OF THE PREFERRED EMBODIMENT

Figure 1:
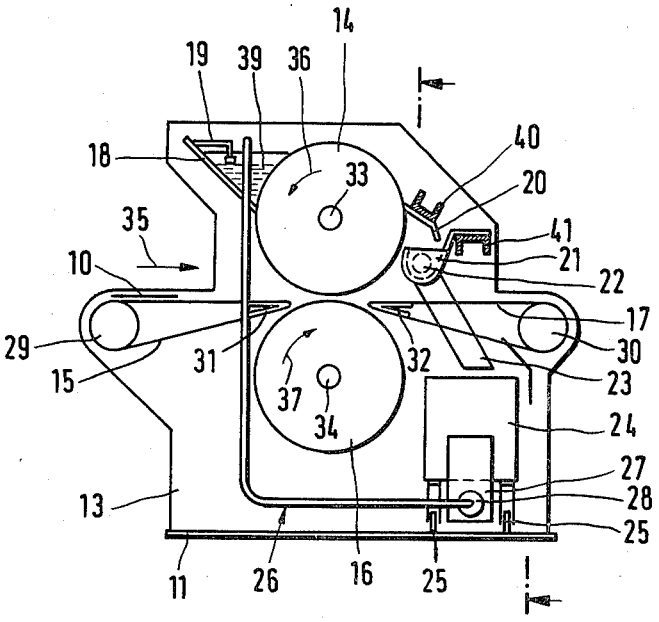
FIG. 1 is a longitudinal section through an apparatus according to the invention along the section line in FIG. 2.
Figure 2:
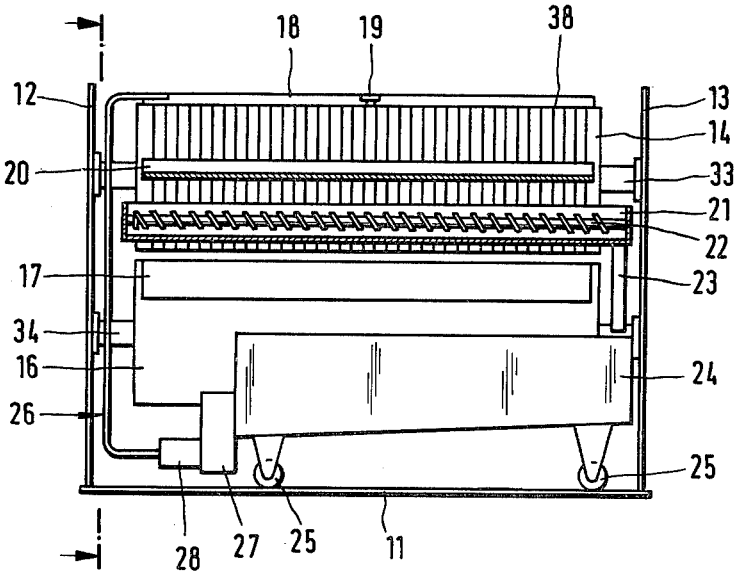
FIG. 2 is a section through the sectional line shown in FIG. 1.

The apparatus illustrated in FIGS. 1 and 2 comprises a frame 11 having side walls 12, 13. Conveyor belts 15, 17 and roller 16 with axle 34 are mounted on the side walls in an appropriate manner. The conveyor belts are guided via rolls 29, 30 and guide plates 31, 32, and are driven by means of the rolls. The drive of the rolls 29, 30 and of the roller 16, i.e. the axle 34 thereof is effected in a known manner and is not illustrated. The roller 16 is driven in the direction of the arrow 37. The conveyor mechanism conveys textile sheets in the direction of the arrow 35 when they are laid onto the conveyor belt 15. It is advantageous to equip the roller 16 with a plastic-repellent lining.

Arranged above the conveyor mechanism is the printing cylinder 14 with axle 33. The printing cylinder is driven, by known drive means (not illustrated) at the same speed in the direction of the arrow 36 as the conveyor belts 15, 17 and the roller 16 of the conveyor mechanism. The printing cylinder 14 is designed as a gravure printing cylinder and has, in this respect, a plurality of circumferential grooves 38.

Associated with the printing cylinder 14 is a feed reservoir 18 for the plastic 39 with which the textile sheets 10 are to be coated. A level switch 19 is arranged on the feed reservoir 18 for detecting the fill level therein. On the rear side of the printing cylinder 14 a cleaning doctor blade 20 for the cylinder is arranged on a cross-strut 40 of the frame 11. Arranged on a further cross-strut 41 is a collecting trough 21. The plastic removed from the printing cylinder 14 by the doctor blade 20 flows directly into this collecting trough 21 due to the illustrated construction of the doctor blade. Arranged in the lower region of the elongate collecting trough 21 is a conveyor screw 22 which conveys the plastic in the collecting trough 21 to the discharge chute 23 situated at the disharge end of this trough. A supply reservoir 24 is arranged beneath the discharge chute 23. The supply reservoir 24 has an inclined bottom so that plastic deposited therein flows to a conveying device 26, which includes a feed pump 27 and a filter 28 located at the front end of the reservoir. The supply reservoir 24, together with the conveying device 26 mounted thereon, can be removed from the apparatus due to the arrangement of the runners 25 on said supply reservoir, so that easy servicing is possible. The collecting trough 21 with the conveyor screw 22 is also designed to be laterally movable, with a view to easy servicing. However, this construction is not illustrated in the drawing.

Moreover, the apparatus has all further devices and parts (not illustrated) necessary for its operation, such as, for example, an electrical control device.

In operation, a textile sheet 10 laid by the operator onto belt 15 is conveyed in the direction of the arrow 35 and accordingly, enters the nip between the roller 16 and the printing cylinder 14. Since the grooves 38 of the printing cylinder 14 are filled with plastic 39 as the cylinder moves past the feed reservoir 18, and the nip between the printing cylinder 14 and the roller 16 is smaller than the thickness of the textile sheet 10, the textile sheet 10 is coated with lines of plastic as it passes through the nip. As a result of the circumferential arrangement of the grooves 38 on the periphery of the printing cylinder 14, the coating lines lie parallel to the conveying direction (arrow 35) of the conveyor mechanism. Since plastic 39 is fed constantly to the printing cylinder 14 during the operation of the apparatus, even when no textile sheet 10 lies in the nip between the printing cylinder 14 and roller 16, and fluff and the like is caught up on the printing cylinder 14 as the textile sheet 10 is coated, the rotating cylinder is continuously cleaned by the doctor blade 20. The impurities and excess plastic removed from the elevations and depressions of the surface of the printing cylinder 14 by the permanently resilient wiping edge of the doctor blade 20 flow into the collecting trough 21. The conveyor screw 22 arranged in the lower region of the collecting trough 21 extends over the entire length of the printing cylinder 14 and conveys the removed plastic to the discharge chute 23 arranged at its end, whence said plastic flows into the supply reservoir 24. The unused, used and partly contaminated plastic situated in the supply reservoir 24 flows, due to the inclined construction of this container, to the conveying device 26 which includes feed pump 27 and filter 28. The conveying device delivers the plastic located in the supply reservoir into the feed reservoir 18 under the control of the level switch 19 arranged on the feed reservoir and the filtering occurs simultaneously. To the extent that it is not used up in a coating operation, the plastic is therefore recycled in a controlled manner and, in the course thereof, is filtered before every delivery to the feed reservoir the plastic being conveyed in a substantially free-flowing manner from the printing cylinder 14 to the supply reservoir 24 and in a forced manner from the supply reservoir to the feed reservoir 18.

What is claimed is:

1. An apparatus for stiffening textile sheets of various shapes for the manufacture of outerwear fabrics, said apparatus including conveyor means for the textile sheets, a gravure printing cylinder disposed above said conveyor means, and plastic feed means for supplying plastic to said printing cylinder, comprising:

(a) a plurality of circumferential grooves (38) axially spaced along the length of the cylinder (14) defining surface elevations and plastic carrying depressions therein, (b) a feed reservoir (18) for coating the surface of the cylinder with plastic (39), said reservoir being disposed on the textile sheet entry side of the cylinder relative to the direction of conveyance, (c) a level switch (19) operatively associated with the feed reservoir for detecting the plastic fill level therein, (d) a doctor blade (20) including a resilient edge mounted in wiping contact with said printing cylinder for cleaning the surface elevations and depressions thereof, said doctor blade being disposed on the textile sheet exit side of the cylinder, (e) a transverse collecting trough (21) disposed below the doctor blade and above a discharge conveyor belt (17) for collecting plastic and contaminant material removed from the cylinder by the doctor blade, (f) a discharge device comprising a conveyor screw (22) disposed in a lower region of said collecting trough, (g) a discharge chute (23) disposed at one end of said screw and trough.

(h) a movably mounted supply reservoir (24) disposed below the collecting trough and discharge chute for receiving material discharged therefrom, and (i) conveying means (26) including a feed pump (27) and a filter (28) for conveying plastic from the supply reservoir to the feed reservoir while simultaneously removing contaminants therefrom, said conveying means being controlled by the level switch of the feed reservoir.

2. Apparatus according to claim 1, wherein the supply reservoir has a downwardly sloping bottom, the discharge chute feeds the higher end of the reservoir bottom, and the feed pump is coupled to the lower end of the reservoir bottom.

* * * * *